US010591214B2

(12) United States Patent
Fradette et al.

(10) Patent No.: US 10,591,214 B2
(45) **Date of Patent: *Mar. 17, 2020**

(54) SIMPLIFIED AND IMPROVED THERMAL EFFICIENCY VACCUM FURNACE HOT ZONE WITH PREFABRICATED INSULATION ASSEMBLY

(71) Applicants: Real Fradette, North Wales, PA (US); Benjamin Isaak, Souderton, PA (US)

(72) Inventors: Real Fradette, North Wales, PA (US); Benjamin Isaak, Souderton, PA (US)

(73) Assignee: William R. Jones, Telford, PA (US)

( * ) Notice: Subject to any disclaimer, the term of this patent is extended or adjusted under 35 U.S.C. 154(b) by 231 days.

This patent is subject to a terminal disclaimer.

(21) Appl. No.: 15/732,228

(22) Filed: Oct. 10, 2017

(65) Prior Publication Data

US 2019/0107328 A1 Apr. 11, 2019

(51) Int. Cl.
*F27D 1/00* (2006.01)
*F27D 1/14* (2006.01)
(Continued)

(52) U.S. Cl.
CPC ..... *F27D 1/0033* (2013.01); *F27D 1/0036* (2013.01); *F27D 1/145* (2013.01); *F27D 7/06* (2013.01); *F27D 9/00* (2013.01); *F27D 11/02* (2013.01); *F27D 2007/066* (2013.01); *F27D 2009/0013* (2013.01); *F27D 2009/0075* (2013.01)

(58) Field of Classification Search
CPC ..... F27D 11/02; F27D 1/0033; F27D 1/0036; F27D 1/145; F27D 2007/066; F27D 7/06; F27D 9/00
USPC ..... 266/114, 249, 250, 252, 208, 283, 286; 373/109, 110, 111, 112, 113, 114, 117, 373/118, 120, 122, 125, 128, 130, 132, 373/134, 137; 219/390, 408, 520, 532, 219/539, 541, 542, 552, 553
See application file for complete search history.

(56) References Cited

U.S. PATENT DOCUMENTS 4,259,538 A 3/1981 Jones
4,489,920 A * 12/1984 Jones ..... F27D 1/00 266/208

(Continued)

OTHER PUBLICATIONS

U.S. Appl. No. 15/330,396, filed Sep. 16, 2016, Fradette, et. al.

*Primary Examiner* — Scott R Kastler
*Assistant Examiner* — Michael Aboagye
(74) *Attorney, Agent, or Firm* — Aaron Nerenberg

(57) ABSTRACT

A high temperature vacuum furnace including a prefabricated tongue-and-groove, low-mass insulation ring assembly hot zone, resulting in decreased energy costs and increased energy efficiency, faster heating and cooling cycles, and expedited maintenance capability resulting in lower maintenance costs. Decreased time of a workpiece in the furnace improves production turnaround and lowers energy costs for each heat treating cycle. Furnace manufacturing is also easier and less expensive compared to prior art vacuum furnaces. A bottom support structure replaces the prior art metal support ring resulting in an approximately 80-85% weight saving in the furnace hot zone. This reduces the time and energy required to heat and cool the furnace components and workpiece.

42 Claims, 11 Drawing Sheets

(51) Int. Cl.

| | |
|---|---|
| ***F27D 7/06*** | (2006.01) |
| ***F27D 9/00*** | (2006.01) |
| ***F27D 11/02*** | (2006.01) |

(56) References Cited

U.S. PATENT DOCUMENTS

| | | | | |
|---|---|---|---|---|
| 4,559,631 | A | 12/1985 | Moller | |
| 6,021,155 | A | 2/2000 | Jones | |
| 7,514,035 | B2 | 4/2009 | Jones | |
| 9,187,799 | B2 | 11/2015 | Wilson et al. | |
| 9,702,627 | B2 | 7/2017 | Wilson et al. | |
| 2003/0160088 | A1* | 8/2003 | Mitten ..... | B23K 1/008 228/219 |
| 2013/0175256 | A1 | 7/2013 | Moller et al. | |

* cited by examiner

SIMPLIFIED AND IMPROVED THERMAL EFFICIENCY VACCUM FURNACE HOT ZONE WITH PREFABRICATED INSULATION ASSEMBLY

FIELD OF THE INVENTION

This invention relates to high temperature vacuum heat treating furnace hot zones that include electric resistance heating elements, a high strength, high density, low conductivity, and low moisture-sensitive graphite insulation ring assembly in the form of a prefabricated single polygon unit comprised of HEFVAC graphite insulation boards. In one embodiment the outer surfaces of the boards are encompassed by a very thin stainless steel sheet acting as a reflective shield, and held in place by high pressure cooling nozzle fastener nuts, for producing high thermal efficiency during a high temperature vacuum heat treating cycle, and improved cooling efficiency during high pressure gas quenching. The HEFVAC insulation board assembly is supported only by a low mass support structure located at the bottom portion of the hot zone, as compared to the prior art continuous support ring.

BACKGROUND OF THE INVENTION

With rising energy costs, especially high electric costs, and electricity use restrictions placed on heat treating companies in many states and countries, the need to develop more energy efficient heat treating furnace hot zones is a key priority. The furnace hot zone is the area within the furnace chamber in which a work piece is placed to be heat treated and consists of a furnace hearth for placing a workload to be heat treated, heating elements, a power supply terminal, cooling gas nozzles, and an insulation package to ensure that the temperature is uniform throughout the heating cycle. The present invention includes some notable improvements over prior art hot zone arrangements for saving energy and reducing the overall costs of manufacturing, owning and operating a vacuum furnace. A uniquely designed prefabricated insulation assembly, heating elements and their connection joints, and lower mass cooling nozzles, result in improved energy consumption by the vacuum furnace, easier furnace fabrication and maintenance, and a significant reduction in the initial cost to build the furnace compared to current graphite vacuum furnace hot zones.

Less mass in the furnace hot zone reduces the time for both heating and cooling the furnace and the workload placed in the furnace to be heat treated. A reduced mass hot zone in a high temperature and high pressure gas-cooled vacuum furnace must be able to withstand the force of the cooling gasses at the high pressures needed to achieve the desired metallurgical properties for various tool steels, alloy steels and aerospace alloys that are being processed. The hot zone requires some form of support so that its components remain stable during both the heating and cooling cycles. The key support feature of all current and older vacuum furnaces, featuring gas cooling pressures above atmospheric pressure, utilize a continuous, fully enclosed steel support ring enclosure. This ring enclosure connects and retains all the components of the hot zone, insulation package, heating elements, hearth, gas nozzles and power terminals.

It is well known in prior art vacuum furnace fabrication that the hot zone contains an inner insulating wall and a fully enclosed outer wall known as the support ring—U.S. Pat. Nos. 9,187,799; 7,514,035; 4,559,631; 4,259,538; 4,489,920; 6,021,155; US2013/0175256A; and U.S. patent application Ser. No. 15/330,396. The outer wall support ring typically is fabricated as a stainless steel or carbon steel ring and is situated and isolated within a water-cooled chamber. The inner insulating wall typically is fabricated with all metal radiation shields or a combination of graphite felt and foil, or rigidized graphite board. In one instance described in U.S. Pat. No. 4,489,920, and in U.S. patent application Ser. No. 15/330,396, a standard, fully enclosed stainless steel support ring is utilized to support the insulation ring package in the vacuum furnace hot zone. The present invention is an improvement over the prior art in that it eliminates this high mass stainless steel support ring and further reduces energy costs by reducing the overall mass of the furnace hot zone. The present design, as described and claimed in this application, yields a substantial reduction in energy costs over prior art vacuum furnace designs that utilize a stainless steel support ring in the hot zone.

A key feature of the present ringless support design is the glued HEFVAC boards at the juncture of their respective tongue-and-groove edges, using a high strength, high temperature graphite glue or sealant to form a single polygonal structure that does not require substantial support, as do prior art insulation ring packages. The insulation board ring assembly is constructed from a plurality of at least 3 inch thick HEFVAC high density, high strength and low moisture-sensitive graphite insulation boards designed with a tongue-and-groove longitudinal edge, and glued to each adjacent board at each respective connective tongue-and-groove juncture. The glued boards are cured in a two step process. First, air is immediately circulated on the glued tongue-and-groove juncture, and then the glued insulation board ring assembly is cured in a high temperature vacuum heat treatment cycle to produce a single unit insulation assembly ready for installation and placement on the support structure in the furnace hot zone by the furnace manufacturer. The use of the glued insulation board ring assembly reduces radiative losses in the furnace hot zone, since the fluid nature of the glue fills any gaps that were inherent in prior art designs. The shape of the cured insulation board ring assembly is preferably polygonal and can be supported from the bottom only on the support structure, which contacts and surrounds the bottom approximately 35-40% portion of the polygon-shaped insulation board ring assembly. The use of a partial support base instead of the prior art full stainless steel support ring decreases the overall mass of the support structure by approximately 80-85%.

The use of a fully prefabricated and glued HEFVAC graphite insulation board assembly in the hot zone, as described and claimed in the present application, further reduces labor costs to construct the insulation assembly in the hot zone by the furnace manufacturer as in prior art designs, providing substantial savings. The cost savings for manufacture and for heating and cooling operations in the furnace are key features of the present invention over the prior art.

In a preferred embodiment of the present invention the support structure consists of a series of brackets placed strategically throughout the bottom and edges of the chamber wall to support the ringless hot zone.

SUMMARY OF THE INVENTION

These and other deficiencies of the prior art are overcome by the present invention. In one of its aspects this invention provides in a high temperature vacuum furnace including a hot zone comprising an inner wall formed by a plurality of high density, high strength, low conductivity, and low moisture-sensitive graphite insulation board means, each one of said insulation board means being connected at one longitudinal edge thereof to an adjacent board means by a tongue-and-groove connection to form a continuous assembly around said hot zone, and each one of said insulation board means engaging the adjacent insulation board means to provide a tight fit with no gap therebetween, said insulation board means having a thin stainless steel sheet on the outer surface thereof, whereby thermal radiation losses from said hot zone are substantially eliminated, and the insulation board means continuous assembly being fully supported in the hot zone by support structure means in the lower portion of the hot zone, the hot zone further including a plurality of electrical resistance heating element means arranged in a continuous ring within the hot zone adjacent to the insulation board means assembly, each one of the heating element means being operatively connected to an adjacent one of the heating element means at each of their respective longitudinal edges by a first connection means, the heating element means ring being operatively connected to the insulation board means assembly by a plurality of heating element standoff means.

BRIEF DESCRIPTION OF THE DRAWINGS

The accompanying drawings illustrate a preferred embodiment of the invention, as well as other information pertinent to the disclosure, in which.

DETAILED DESCRIPTION OF THE INVENTION

Figure 1:
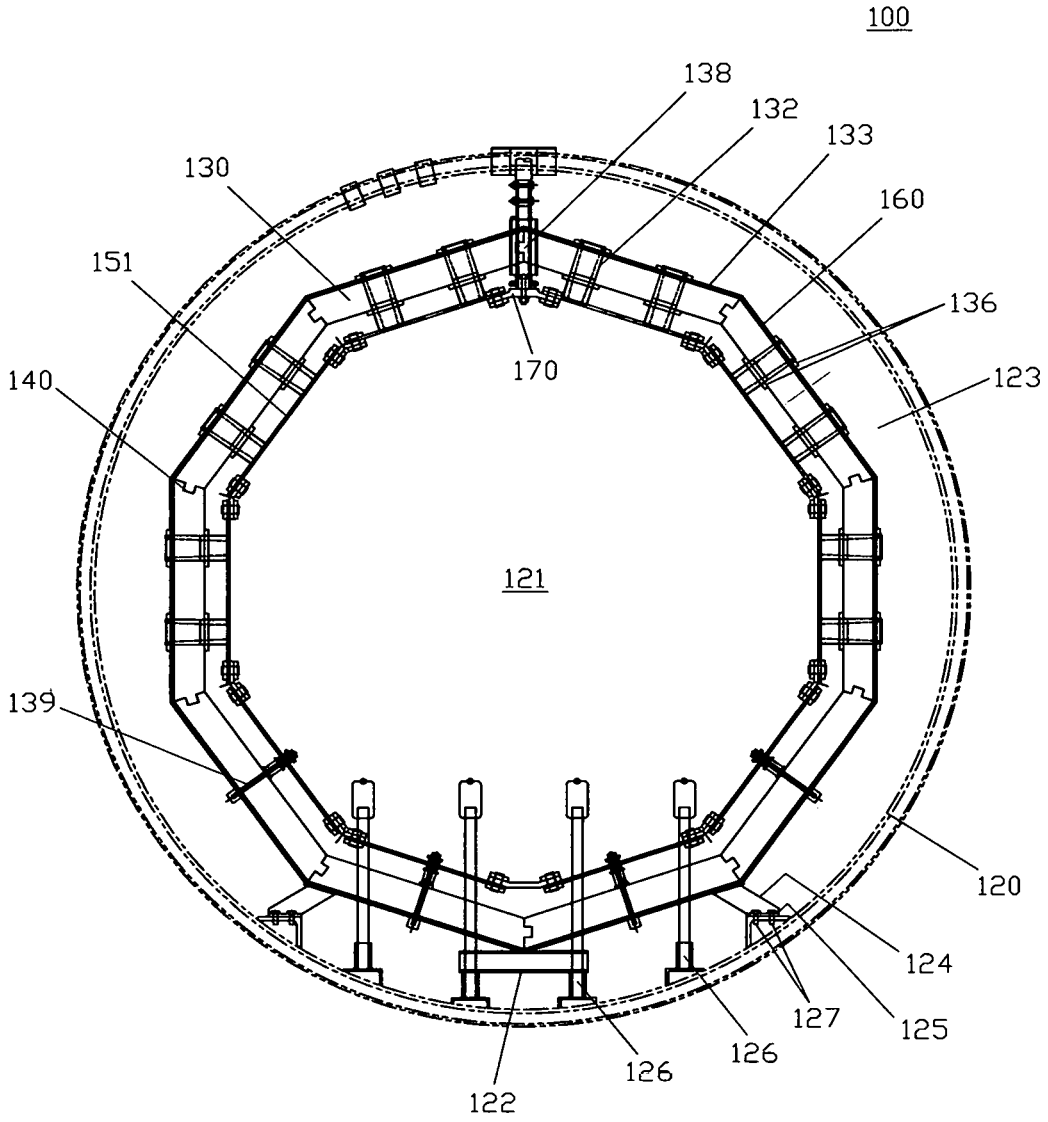
FIG. 1 is an end view of an embodiment of the furnace hot zone according to the present invention showing the arrangement of the HEFVAC graphite insulation boards, the tongue-and-groove design, the thin reflective shield placed on the outer surface of the insulation board wall that is closest to the furnace cold wall, the support structure arrangement, the gas plenum, the heating elements, the gas cooling nozzles and the power supply terminal.
Figure 2:
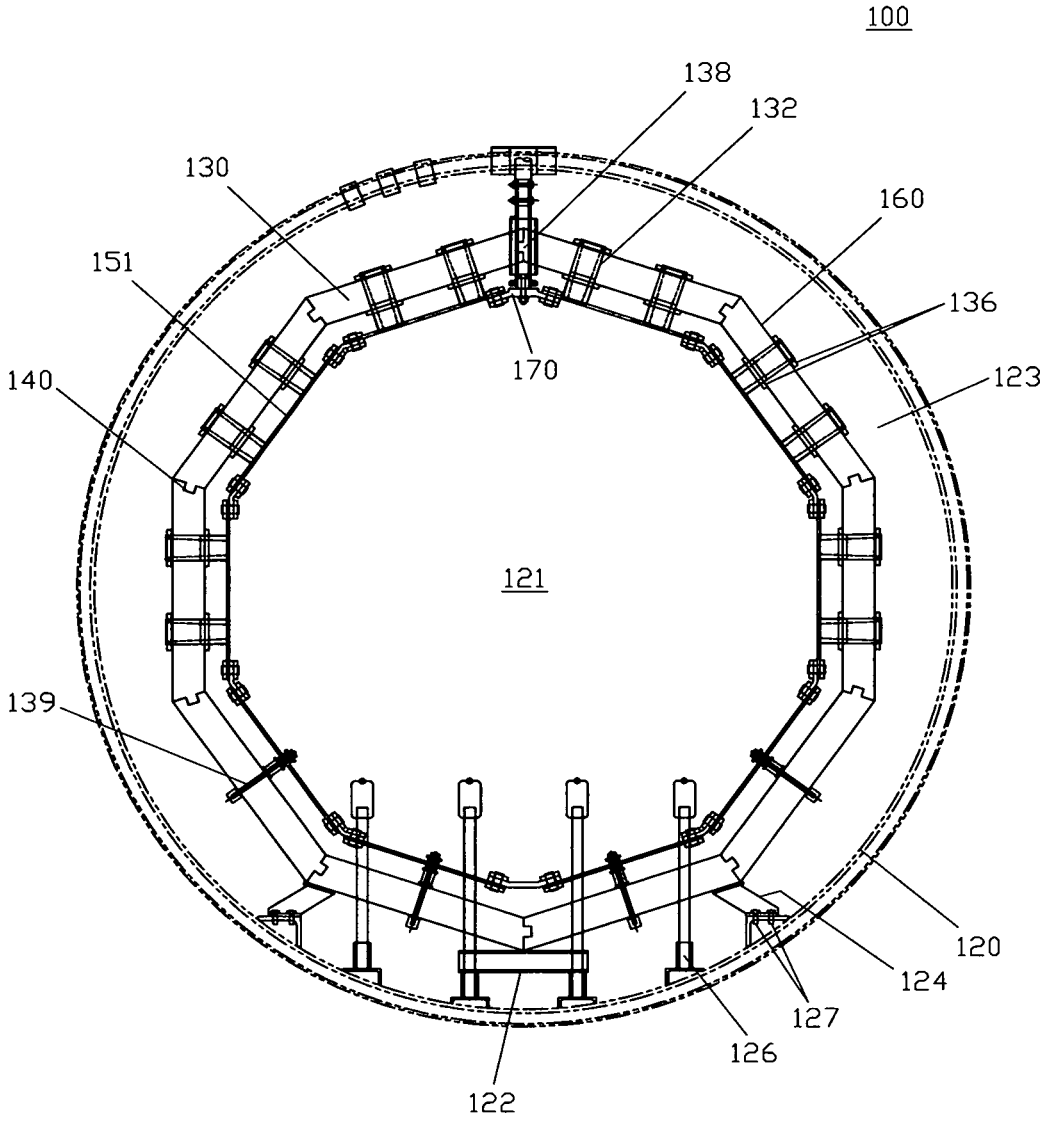
FIG. 2 shows the same end view as in FIG. 1 of another embodiment of the furnace hot zone without the thin reflective shield placed on the outer surface of the insulation board.
Figure 3:
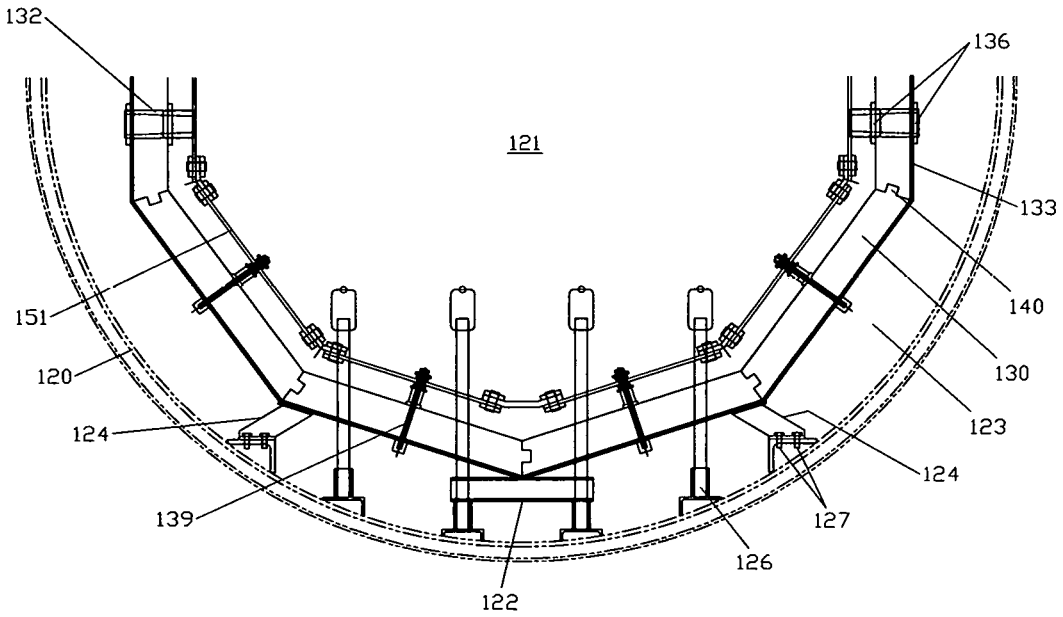
FIG. 3 is a cross-sectional view of the HEFVAC insulation boards as shown in FIG. 1, specifically illustrating the glued tongue-and-groove portion with the insulation board surfaces serving as the respective interior and exterior shell of the hot zone, and a thin stainless steel sheet placed on the exterior surface of the HEFVAC insulation boards which acts as an emissivity shield. Also shown are the gas cooling nozzles and their means of retention to the insulation boards, and the heating elements and their connector brackets.
Figure 4:
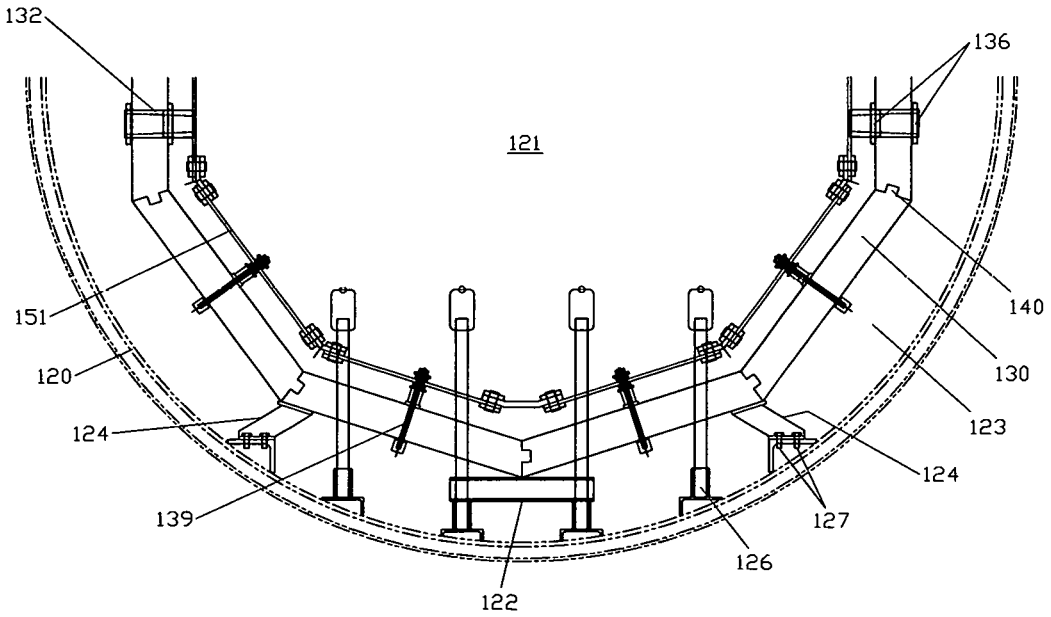
FIG. 4 shows the same cross-sectional view as in FIG. 3 without the stainless steel sheet.

Referring to the drawings in general and particularly to FIGS. 1 through 10B, where like numerals identify like elements, there is shown a vacuum furnace 100 in accordance with the present invention. Furnace 100 typically includes an inner water-cooled chamber wall 120 which supports a hot zone chamber 121. The workload being heat treated is supported on rails (not shown) in the hot zone. The rails are secured in place by a plurality of pins 126 inserted into sockets 128, which are fastened to hot zone chamber wall 120. Hot zone chamber 121 contains a pre-manufactured insulation ring assembly 160 comprised of glued HEFVAC insulation boards 130 of approximately 3 inches thickness. In FIG. 1 a thin reflective stainless steel shield 133, on the order of approximately 0.030 inches thick, is placed on the outside of insulation boards 130. Stainless steel shield 133 provides improved emissivity between insulation ring assembly 160 and inner chamber wall 120. In FIG. 2 outer stainless steel shield 133 is omitted. Also shown in FIGS. 1 and 2 are gas-cooling nozzles 132, a water-cooled power terminal 138 and heating elements 151. Power terminal 138 supplies electrical power to heating elements 151 in order to heat hot zone chamber 121 to a designated temperature. Water-cooled power terminals are well known in the vacuum furnace art and have been described in various prior art patents such as U.S. Pat. Nos. 4,559,631; 4,259,538; 6,021,155; and 9,702,627. Therefore they will not be further described herein with regard to the present invention. Similarly, heating elements 151 and cooling nozzles 132 are also well known in the vacuum furnace art and have been described in U.S. patent application Ser. No. 15/330,396. Accordingly they will not be further described with regard to the present invention.

An open space between hot zone 121 and water-cooled inner chamber wall 120 serves as a gas plenum 123, where high velocity cooling gas can flow from a quench fan (not shown) through the gas cooling nozzles 132 to the work piece (not shown) in hot zone 121. During vacuum heating, plenum 123 is under vacuum, and any radiative or conductive heat loss from stainless steel shield 133 (FIG. 1) or insulation boards 130 outer surface (FIG. 2), and gas nozzles 132 will be lost to water-cooled wall 120.

The design of nozzles 132 are described fully in U.S. patent application Ser. No. 15/330,396 as nozzles that have a smaller outer radius (thinner wall) to reduce the mass of the nozzle as compared to the nozzles described and shown in prior art U.S. Pat. Nos. 9,187,799 and 7,514,035. The present lower mass nozzle design results in improved energy efficiency. Nozzles 132, as shown in FIGS. 1, 2, 5A, 5B and 9 are preferably made from low thermal conducting refractory material, preferably graphite. Nozzles 132 have a threaded end 134 (FIG. 9) that are inserted into stainless steel sheet 133 (FIG. 1) or boards 130 (FIG. 2). The nozzles are tightened into place by retaining nuts 136. One nut 136 is screwed in at the inner wall of insulation boards 130, and a second nut 136 is screwed onto the stainless steel sheet 133 (FIG. 1) or the outer wall of insulation boards 130 (FIG. 2), such that the second retaining nut is on the plenum 123 side of the furnace. Retaining nuts 136 are placed on each side of an insulating board 130 to ensure that nozzles 132 remain in place. Nuts 136 are typically manufactured from graphite, but they can be made from molybdenum (or its alloys) or from ceramic material. The key feature of the nozzle 132 design resides in its lower overall mass.

Insulation boards 130, shown in greater detail in FIGS. 3, 4, 5A and 5B are made of highly efficient, high strength and density, low moisture-sensitive graphite (HEFVAC), and manufactured according to a proprietary process. Boards 130 are designed to tightly set specifications in order to fit the cylindrical vacuum furnace chamber 100 and form the specified hot zone 121. Each insulation board 130 segment is connected at one of its longitudinal edges to one of the longitudinal edges of an adjacent board 130 segment by means of a tongue-and-groove design 140 on each longitudinal edge of every board. Each board adheres to an adjacent board by the use of a proprietary high temperature graphite glue, such that the boards fit together in a complementary engagement manner with each other to form a cohesive insulation assembly 160 with no gaps. The glued insulation ring assembly 160 is cured at a high temperature to produce a stable single unit insulation ring assembly that can be placed in vacuum chamber 100. This arrangement of board 130 segments joined together at tongue-and-groove joints 140 is clearly shown in FIGS. 3, 4, 5A and 5B. Standard right-angled rigid graphite boards, currently used in prior art felt board construction, suffer from gaps that result in radiation losses from the hot zone during the heating cycle. The dimensions of each insulation board 130, according to the present invention, are determined by the overall diameter of hot zone 121, such that a polygon layout is formed within the hot zone.

While the present preferred embodiment utilizes flat insulation board 130 segments, it should be understood by those skilled in the high temperature vacuum furnace art that curved (or other-shaped) insulation boards could be used that would form a continuous curved layout with no gaps within hot zone 121 when connected together in the unique manner described and illustrated herein without departing from the scope of the present invention.

The prior art hot zones manufactured with rigid graphite boards require custom fitting to each hot zone. This must be done during the actual hot zone construction in the furnace manufacturing facility and is time consuming, with a great deal of wasted product. The present HEFVAC graphite insulating board 130 segments are precut at the board manufacturing facility to tight specifications in order for the tongue-and-groove joints 140 to fit snugly together, yet slide readily into position. The inner and outer surfaces of each board 130 are coated with graphite polymer paint in order to seal each board for less moisture absorption (especially on humid days), and then the completed hot zone 121 is pre-conditioned by being baked at a temperature of approximately 1800° C. prior to assembly of insulation assembly 160. This results in minimal out-gassing and introduction of contaminating gasses during the heating-up portion of the cycle in the furnace. It also allows faster and deeper vacuum levels for each given cycle, and reduced cycle times with less energy consumption. The board manufacturer assembles insulation ring assembly 160 in such a way that board 130 segments are coated along the tongue-and-groove with high temperature graphite glue, and then insulation ring 160 is assembled. All necessary apertures for the components of hot zone 121—nozzles 132, heating element standoffs 139 (as descried fully in U.S. Pat. No. 9,702,627), and rail pins 126—are pre-drilled in board 130 segments to the specifications of each component prior to assembling insulation ring assembly 160. Maintaining tight specifications of the apertures substantially eliminates thermal radiation losses from the exposed space between insulation board 130 segments. The construction of insulation ring assembly 160 is completed in a matter of hours rather than days. The glue is set between the boards and the boards are immediately placed in an air oven for an initial cure at a temperature of at least 300° F. for at least 24 hours. Once the initial cure is finished, the assembled insulation ring 160 is completely cured (or graphitized) in a vacuum furnace at a temperature of at least 1500° F. for at least 24 hours. The sealed and cured assembled insulation ring 160 results in better vacuum levels in the furnace than current felt/foil insulation designs due to reduced absorption of atmospheric moisture.

Figure 5A:
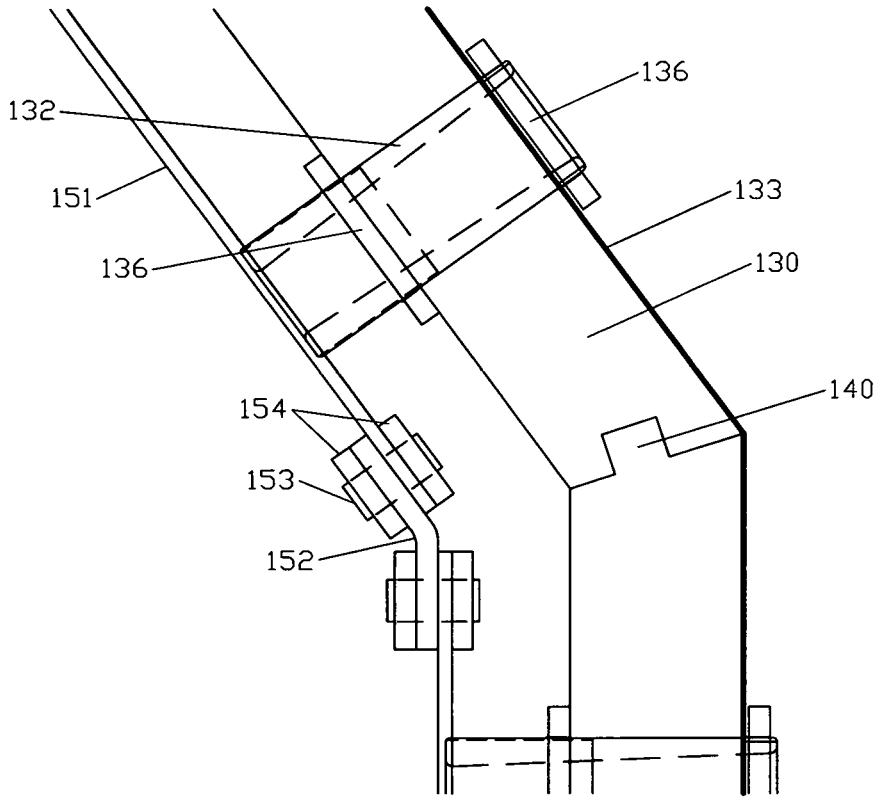
FIG. 5A is a cross-sectional view of the support structure for the HEFVAC insulation board ring assembly with the reflective shield placed on the exterior surface of the HEFVAC insulation boards.
Figure 5B:
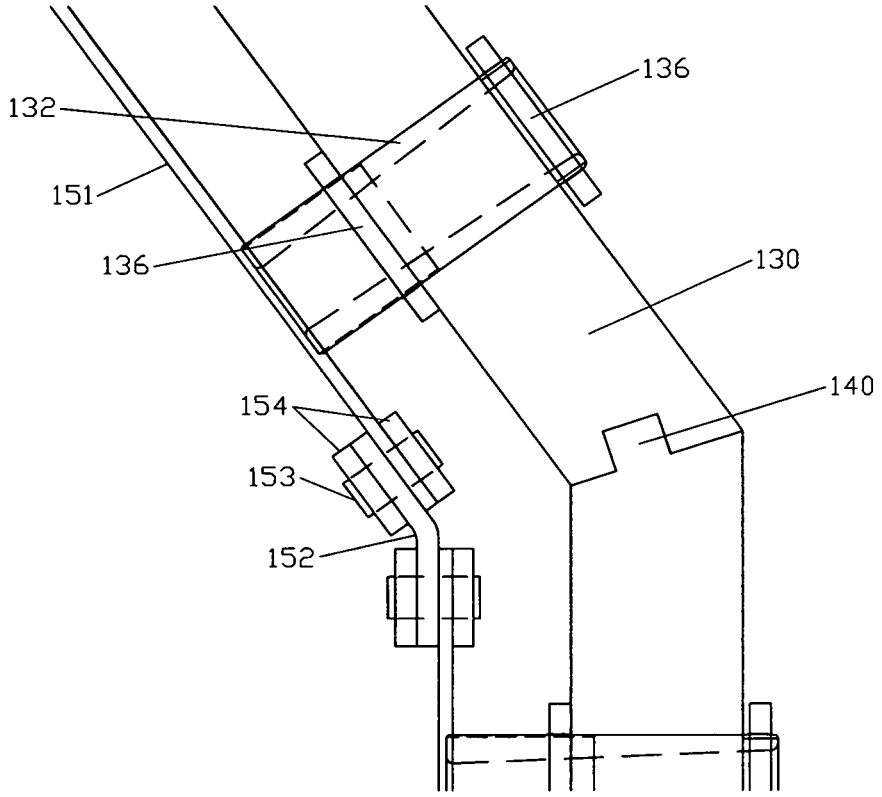
FIG. 5B is the same view as in FIG. 5A without the stainless steel sheet.

As shown in FIGS. 1 and 5A, thin stainless steel sheet 133 (0.030 inches thick) is cut in segments based on the length of the hot zone and arranged to rest against the board's outer surface. The gas nozzles are used to keep the stainless steel sheet 133 attached to each board 130. As shown in FIGS. 1, 2, 5A, 5B, 10A and 10B, support structures 122 and 124 made of stainless steel or carbon steel are strategically placed in three locations within furnace chamber 100. Structure 122 is attached to the center rail pins 126 directly below the hearth at the 6 o,clock position. Structures 124 are anchored to the chamber wall 120 using three hex screws 127 in pin openings 125 (FIG. 10B), which are fastened to hot zone chamber wall 120. These structures are permanently affixed to the furnace chamber, and the hot zone 121 is capable of being moved in and out of furnace chamber 100. Support structures 122 and 124 are placed throughout the furnace chamber based on the length of hot zone 121, and they fully support insulation ring assembly 160.

Figure 6:
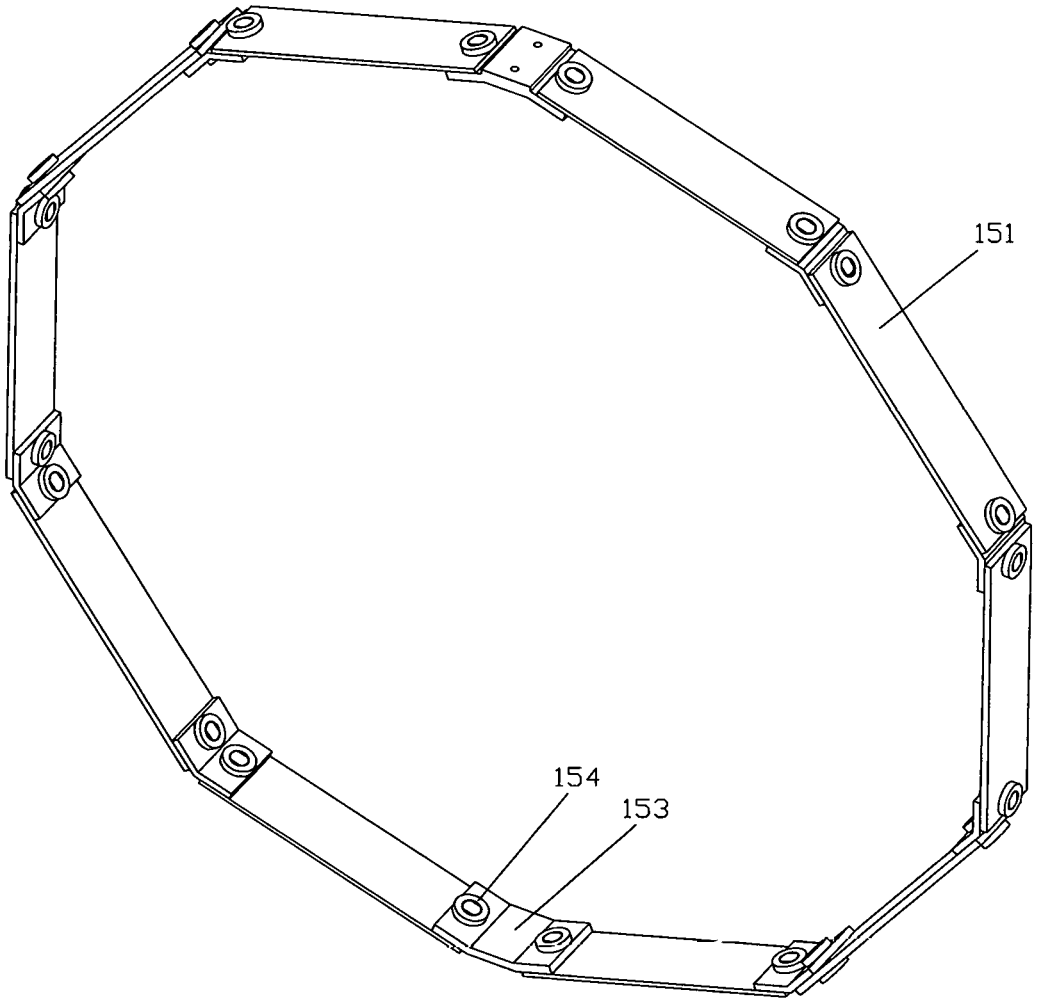
FIG. 6 is a perspective view of a polygonal heating element ring as shown in FIG. 1, specifically showing the connection means between each heating element segment.
Figure 7:
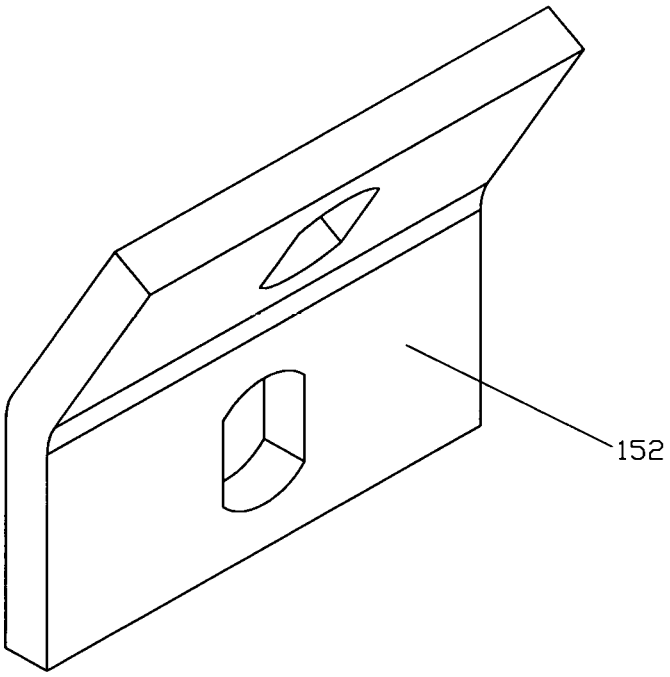
FIG. 7 is a perspective view of a heating element connector plate for connecting individual heating element segments.

FIGS. 1, 2 and 6 show in detail the new polygon-shaped heating element design. Each heating element 151 ring is manufactured from a single high purity graphite block and cut into segments having identical dimensions, thereby providing rectangular segments with equal resistance. The ability to manufacture more than one element segment from a single block of graphite significantly reduces the overall cost of the heating element 151 ring compared to the standard prior art curved design, in which each graphite block produces only one curved graphite heating element segment per block. This is due to the fact that because of the curved shape of a segment, correct equal resistance could not be achieved when producing multiple curved board segments from a single block of graphite. An additional benefit of the present design and method of production is that the process reduces waste of the graphite block material, and therefore is environmentally friendly due to less waste material to dispose of or recycle. This results in a significant cost savings to the furnace manufacturer and to the furnace owners and users.

Figure 8A:
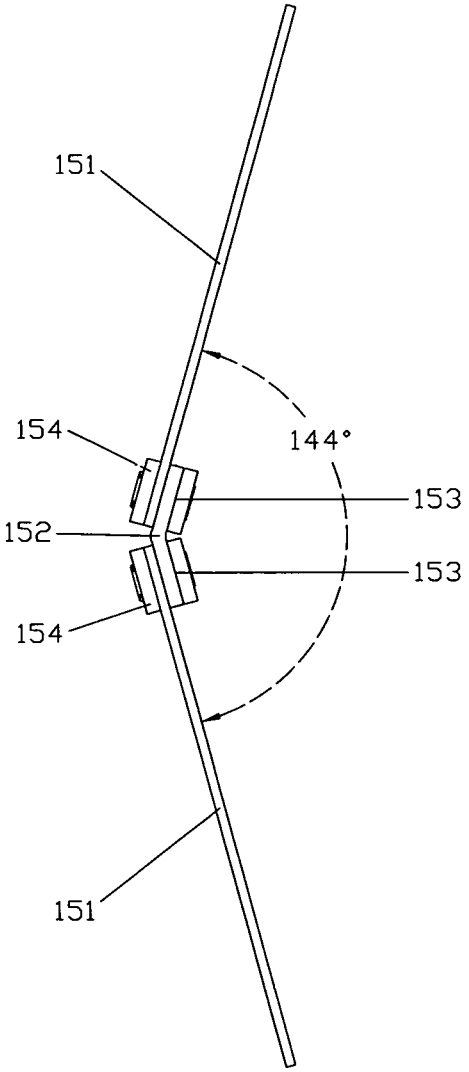
FIG. 8A is a side view showing two individual heating element segments connected by a connector plate, as shown in FIG. 6.
Figure 8B:
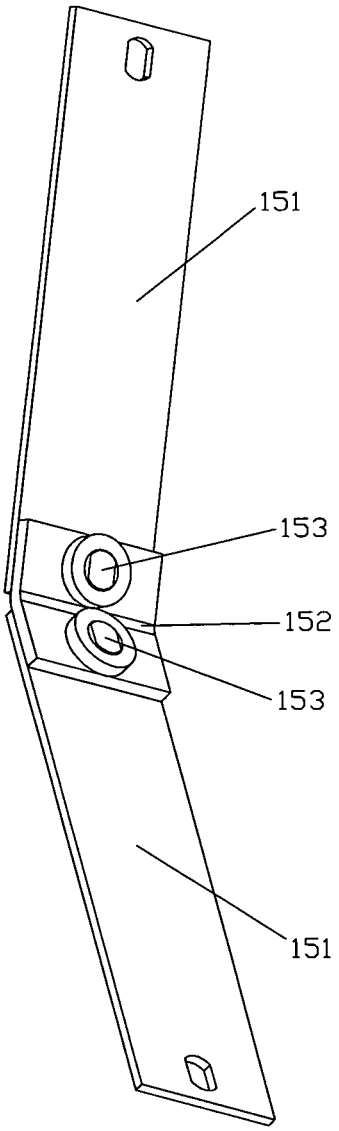
FIG. 8B is a perspective view showing two connected heating element segments, as shown in FIG. 6.
Figure 9:
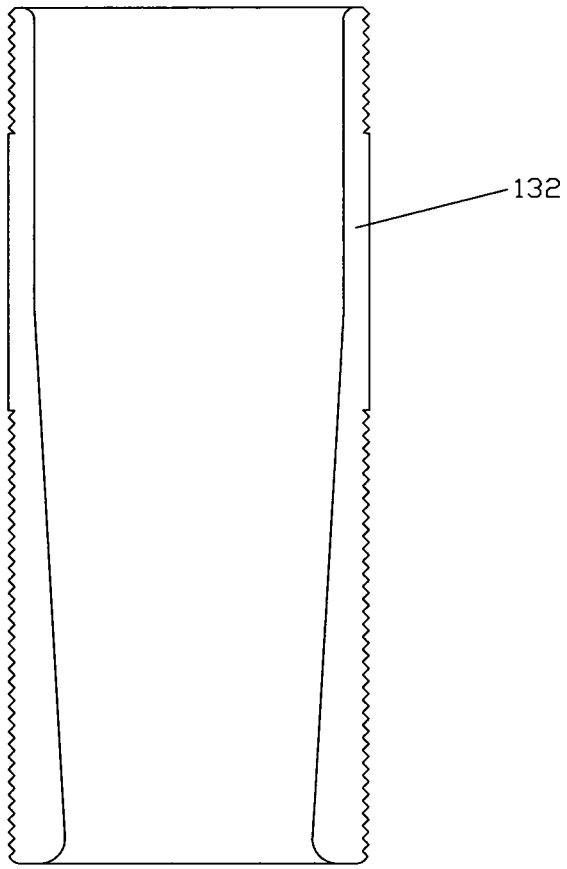
FIG. 9 is a cross-sectional view of a lower mass, streamlined gas-cooling nozzle.
Figure 10A:
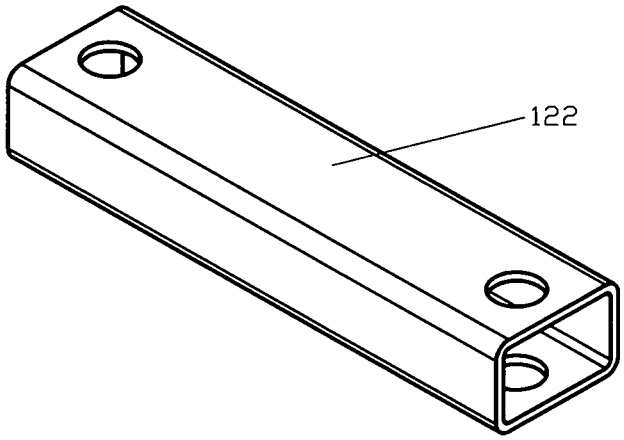
FIG. 10A is an isometric view of one side of the support structure for supporting the insulation board assembly, as shown in FIG. 1.
Figure 10B:
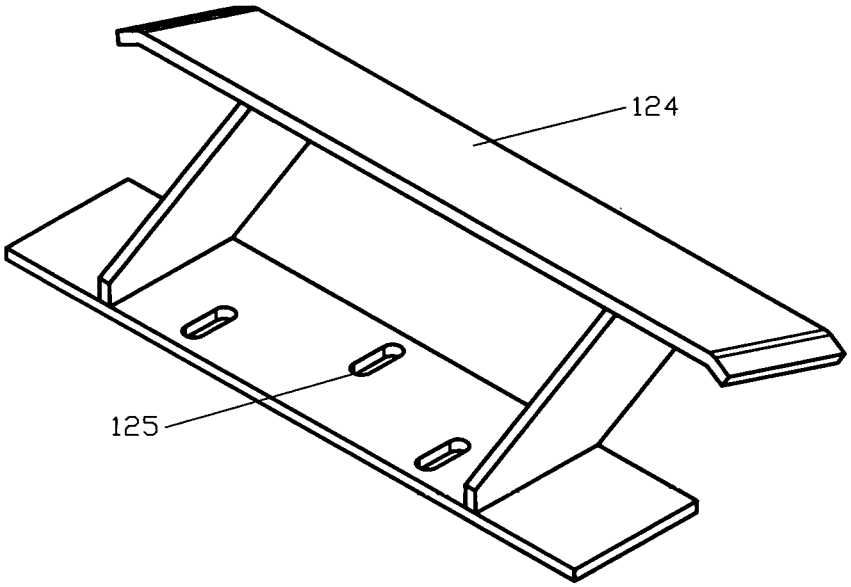
FIG. 10B is a front view of the other side of the support structure which is placed in the furnace hot zone.

In prior art designs any hardware used as a connecting means to ensure that the heating elements function in series introduces a means for wear and fracture of the heating elements during the lifetime of the vacuum furnace, resulting in furnace down time and added maintenance costs. Reduction of the number of connectors not only reduces the risk of fracture, but also reduces the overall mass of the graphite element system, thus saving on the energy needed to heat all of the elements to the desired furnace temperature. As shown in FIGS. 3, 4, 5A, 5B and 6, each heating element is connected in series by an angled graphite connection member 152 which is secured to an adjacent heating element 151 segment by a bolt 153 and a nut 154. Connection member 152 is manufactured preferably from graphite to an internal angle of between 90° to 180°, and preferably between 100° to 165° depending on the diameter of hot zone 121. For example, hot zone 121 with a 57 inch diameter would require connection members with the angle between sections 152A and 152B of 144°, as shown in FIG. 8A. Heating element 151 segment dimensions depend on the diameter of the hot zone. The width, length and thickness of segments 151 are adjusted to provide maximum coverage and ensure that each segment has substantially similar, or preferably, exact resistance to prevent electrical arcing.

Power terminal 138, which supplies electrical power to heating elements 151, is connected at one end thereof to water-cooled furnace outer wall 120 through an aperture in an insulation board 130 segment, and at the other end thereof to a connector plate 170 securing the two heating element 151 segments adjacent power terminal 138 together. The heating element 151 ring is connected in part to insulation board 130 segments that do not otherwise have any other connection means therebetween by a plurality of element stand-offs 139, which are connected at one end thereof to one of the heating element 151 segments, and at the other end thereof to insulation ring assembly 160.

Following are examples of energy efficiency comparisons between the vacuum furnace design according to the present invention and a standard prior art furnace design. Numerous tests were conducted in a laboratory sized vacuum furnace to compare the overall temperature of the stainless steel sheet 133 placed on the outer wall of insulation board 130 at different thicknesses of HEFVAC board, as compared to the prior art hot zone insulation ring for standard felt/foil insulation packages, described in U.S. Pat. Nos. 9,187,799; 7,514,035; 4,559,631; 4,259,538; 6,021,155; and US 2013/0175256A. As noted in Table 1, the outer wall temperature continues to decrease with the increase in thickness of the HEFVAC board. This decrease in temperature results in an increase in energy savings. The total mass of the present invention hot zone compared to standard prior art felt/foil designs are listed in Table 3. The overall mass is decreased by approximately 20%. This decrease in mass results in a faster heat-up rate and cooling rate during the heat treat cycle. The reduction in time of heating and cooling results in improved energy efficiency for the overall heat treat cycle.

The cost of manufacture using 3 inch thick HEFVAC board with the thin stainless steel sheet (0.030 inches) compared to prior art designs using the fully enclosed stainless steel support ring (0.090 inches) is listed in Table 2. This data indicates material cost and does not include labor for assembly. Since assembly of insulation package 160 is provided by the board manufacturer as a finished product, the furnace manufacturer offsets the material cost with the savings from the cost of labor to build and assemble the insulation package 160 at its facility, as compared with the labor needed to custom build and assemble a prior art design insulation package including the heavy metal support ring.

TABLE 1

Temperature Comparisons of Outer Wall of the Hot Zone

| INSULATION TYPE | HOLD 1600° F. | HOLD 2000° F. | HOLD 2400° F. |
|---|---|---|---|
| A. HEFVAC 2 inch Board With Foil Face | 341° F. | 367° F. | 456° F. |
| B. HEFVAC 3 inch Board With Foil Face | 282° F. | 325° F. | 370° F. |

TABLE 1-continued

Temperature Comparisons of Outer Wall of the Hot Zone

| INSULATION TYPE | HOLD 1600° F. | HOLD 2000° F. | HOLD 2400° F. |
|---|---|---|---|
| C. HEFVAC 4 inch Board With Foil Face | 229° F. | 262° F. | 292° F. |
| D. Standard 2 inch Felt/Foil | 408° F. | 544° F. | 656° F. |

TABLE 2

Current Material Costs for Hot Zone - Size 36" × 36" × 48"

| | |
|---|---|
| A. Current standard felt/foil insulation package with support ring | $65,400.00 |
| B. Prior HEFVAC insulation package with support ring | $60,800.00 |
| C. Present ringless HEFVAC insulation package | $64,900.00 |

TABLE 3

Total Mass for Furnace Designs

| Hot Zone Part | Felt/Foil Insulation Hot Zone (Lbs.) | Ringless Insulation Hot Zone (Lbs.) With SS Sheet | Ringless Insulation Hot Zone (Lbs.) Without SS Sheet |
|---|---|---|---|
| a. Support Ring | 357 | 0 | 0 |
| b. SS Sheet | 0 | 119 | 0 |
| c. Insulation | 150 | 200 | 200 |
| d. Support Rack | 0 | 70 | 70 |
| e. Nozzles | 72 | 72 | 72 |
| f. Retainers (Pins, etc.) | 100 | 30 | 30 |
| g. Hearth | 120 | 120 | 120 |
| h. Heating Elements | 120 | 120 | 120 |
| Total Weight | 919 | 731 | 612 |

The lower temperatures achieved with the tongue-and-groove design 140 of insulation ring assembly 160 in tests A., B. and C. in Table 1 for the three configurations of HEFVAC 2 inch, 3 inch and 4 inch board with stainless steel shield 133, as compared with the standard 2 inch felt/foil prior art insulation package shown in test D., supports the conclusion that there was less radiative and conductive heat loss from hot zone 121, and therefore increased thermal efficiency. Accordingly, the unique prefabricated HEFVAC insulation board assembly 160 without the heavy metal support ring taught in the prior art is superior and less expensive overall for all of the reasons stated in this description of the invention.

While there have been described what is believed to be a preferred embodiment of the invention, those skilled in the art will recognize that other and further modifications, may be made thereto without departing from the spirit and scope of the invention. It is therefore intended to claim all such embodiments that fall within the scope of the invention.

What is claimed is:

1. A high temperature vacuum furnace including a chamber containing a hot zone being formed to accept and heat treat a stationary workload, said hot zone comprising an inner wall formed by a plurality of high density, high strength, low conductivity, and low moisture-sensitive graphite insulation board means, each one of said insulation board means being connected at one longitudinal edge thereof to an adjacent board means by a tongue-and-groove connection to form a continuous assembly around said hot zone, and each one of said insulation board means engaging the adjacent insulation board means to provide a tight fit with no gap therebetween, said insulation board means having a thin stainless steel sheet on the outer surface thereof, whereby thermal radiation losses from said hot zone are substantially eliminated, said insulation board means continuous assembly being supported in said hot zone by support structure means in the lower portion of said hot zone, said hot zone further including a plurality of electrical resistance heating element means arranged in a continuous ring within said hot zone adjacent to said insulation board means assembly, each one of said heating element means being operatively connected to an adjacent one of said heating element means at each of their respective longitudinal edges by a first connection means, said heating element means ring being operatively connected to said insulation board means assembly by a plurality of heating element standoff means.

2. The high temperature vacuum furnace hot zone in accordance with claim 1 wherein each of said insulation board means contains a plurality of individual boards, each board having an inner surface and an outer surface, and each tongue-and-groove connection being glued between each of said individual boards to form a continuous polygon assembly.

3. The high temperature vacuum furnace hot zone in accordance with claim 2 wherein said glue is a high temperature graphite glue.

4. The high temperature vacuum furnace hot zone in accordance with claim 3 wherein said glued individual boards are cured for at least 24 hours at a temperature of at least 300° F.

5. The high temperature vacuum furnace hot zone in accordance with claim 4 wherein said insulation board continuous assembly is graphitized for at least 24 hours at a temperature of at least 1500° F.

6. The high temperature vacuum furnace hot zone in accordance with claim 1 wherein said insulation board means continuous assembly is capable of being moved in and out of the vacuum furnace chamber.

7. The high temperature vacuum furnace hot zone in accordance with claim 6 wherein said support structure means is secured in place in the vacuum furnace chamber by support means.

8. The high temperature vacuum furnace hot zone in accordance with claim 2 wherein one end of said heating element standoff means is operatively connected through a first aperture in a first one of said insulation boards to said outer surface of said first one of said insulation boards, and the other end of said heating element standoff means is operatively connected to a first one of said heating element means.

9. The high temperature vacuum furnace hot zone in accordance with claim 2 wherein said hot zone further comprises gas cooling nozzle means and wherein one end of said gas cooling nozzle means is operatively connected through a second aperture in a second one of said insulation boards to said outer surface of said second one of said insulation boards, and another end of said gas cooling nozzle means is operatively connected to said inner surface of said second one of said insulation boards.

10. The high temperature vacuum furnace hot zone in accordance with claim 2 wherein said hot zone further comprises power terminal means for supplying electrical power to said heating element means, said power terminal means being operatively connected at one end thereof to an outer wall of the furnace and being operatively connected at another end thereof through said outer surface of a third one of said individual boards and through a third aperture in said third one of said insulation boards to said heating element means.

11. The high temperature vacuum furnace hot zone in accordance with claim 1 wherein said insulation board means comprises a plurality of elongated board members, each board member having a longitudinal edge thereof formed in a tongue-and-groove profile, and each board member being joined to the adjacent board member at said tongue-and-groove edge to form a tight fit with no thermal or radiation gap therebetween.

12. The high temperature vacuum furnace hot zone in accordance with claim 1 wherein said heating element first connection means is in the form of a connector plate means having more than one aperture therein formed to accept fastening means for securing said connector plate means to two adjacent heating element means.

13. The high temperature vacuum furnace hot zone in accordance with claim 12 wherein said connector plate means is formed with an angle of between approximately 90° to 180° between the ends thereof.

14. The high temperature vacuum furnace hot zone in accordance with claim 12 wherein said connector plate means is formed with an angle of between approximately 100° to 165° between the ends thereof.

15. The high temperature vacuum furnace hot zone in accordance with claim 12 wherein said connector plate means is formed with an angle of approximately 144° between the ends thereof.

16. The high temperature vacuum furnace hot zone in accordance with claim 9 wherein the ones of said insulation board means that are not otherwise secured to said outer surface of one of said individual boards by said heating element standoff means and said gas cooling nozzle means, are secured to said hot zone by retainer pin means, one end thereof being operatively secured to said outer surface of said one of said individual boards and the other end thereof being operatively secured to said heating element means.

17. The high temperature vacuum furnace hot zone in accordance with claim 9 wherein said gas cooling nozzle means is tapered at one end thereof and has a reduced mass for providing greater thermal energy efficiency and reduced conductive heat loss from said hot zone.

18. The high temperature vacuum furnace hot zone in accordance with claim 2 wherein the furnace includes a water-cooled outer wall and a void between said furnace outer wall and said outer surfaces of said individual boards forming a plenum for the transmission of high velocity cooling gas to flow through said gas cooling nozzle means to the workpiece in said hot zone.

19. The high temperature vacuum furnace hot zone in accordance with claim 1 wherein said insulation board means assembly is in the shape of a polygon.

20. The high temperature vacuum furnace hot zone in accordance with claim 1 wherein said heating element means ring is in the shape of a polygon.

21. The high temperature vacuum furnace hot zone in accordance with claim 1 wherein said insulation board means is coated with a polymeric graphite coating means for providing faster pump down rates, deeper vacuum levels, and reduced cycle times with less energy consumption during a heat treating cycle.

22. A high temperature vacuum furnace including a chamber containing a hot zone being formed to accept and heat treat a stationary workload, said hot zone comprising an inner wall formed by a plurality of high density, high strength, low conductivity, and low moisture-sensitive graphite insulation board means, each one of said insulation board means being connected at one longitudinal edge thereof to an adjacent board means by a tongue-and-groove connection to form a continuous assembly around said hot zone, and each one of said insulation board means engaging the adjacent insulation board means to provide a tight fit with no gap therebetween, whereby thermal radiation losses from said hot zone are substantially eliminated, said insulation board means continuous assembly being supported in said hot zone by support structure means in the lower portion of said hot zone, said hot zone further including a plurality of electrical resistance heating element means arranged in a continuous ring within said hot zone adjacent to said insulation board means assembly, each one of said heating element means being operatively connected to an adjacent one of said heating element means at each of their respective longitudinal edges by a first connection means, said heating element means ring being operatively connected to said insulation board means assembly by a plurality of heating element standoff means.

23. The high temperature vacuum furnace hot zone in accordance with claim 22 wherein each of said insulation board means contains a plurality of individual boards, each board having an inner surface and an outer surface, and each tongue-and-groove connection being glued between each of said individual boards to form a continuous polygon assembly.

24. The high temperature vacuum furnace hot zone in accordance with claim 23 wherein said glue is a high temperature graphite glue.

25. The high temperature vacuum furnace hot zone in accordance with claim 24 wherein said glued individual boards are cured for at least 24 hours at a temperature of at least 300° F.

26. The high temperature vacuum furnace hot zone in accordance with claim 25 wherein said insulation board continuous ring is graphitized for at least 24 hours at a temperature of at least 1500° F.

27. The high temperature vacuum furnace hot zone in accordance with claim 22 wherein said insulation board means continuous assembly is capable of being moved in and out of the vacuum furnace chamber.

28. The high temperature vacuum furnace hot zone in accordance with claim 27 wherein said support structure means is secured in place in the vacuum furnace chamber by support means.

29. The high temperature vacuum furnace hot zone in accordance with claim 23 wherein one end of said heating element standoff means is operatively connected through a first aperture in a first one of said insulation boards to said outer surface of said first one of said insulation boards, and the other end of said heating element standoff means is operatively connected to a first one of said heating element means.

30. The high temperature vacuum furnace hot zone in accordance with claim 23 wherein said hot zone further comprises gas cooling nozzle means and wherein one end of said gas cooling nozzle means is operatively connected through a second aperture in a second one of said insulation boards to said outer surface of said second one of said insulation boards, and another end of said gas cooling nozzle means is operatively connected to said inner surface of said second one of said insulation boards.

31. The high temperature vacuum furnace hot zone in accordance with claim 23 wherein said hot zone further comprises power terminal means for supplying electrical power to said heating element means, said power terminal means being operatively connected at one end thereof to an outer wall of the furnace and being operatively connected at another end thereof through said outer surface of a third one of said insulation boards and through a third aperture in said third one of said insulation boards to said heating element means.

32. The high temperature vacuum furnace hot zone in accordance with claim 23 wherein said insulation board means comprises a plurality of elongated board members, each board member having a longitudinal edge thereof formed in a tongue-and-groove profile, and each board member being joined to the adjacent board member at said tongue-and-groove edge to form a tight fit with no thermal or radiation gap therebetween.

33. The high temperature vacuum furnace hot zone in accordance with claim 22 wherein said heating element first connection means is in the form of a connector plate means having more than one aperture therein formed to accept fastening means for securing said connector plate means to two adjacent heating element means.

34. The high temperature vacuum furnace hot zone in accordance with claim 33 wherein said connector plate means is formed with an angle of between approximately 90° to 180° between the ends thereof.

35. The high temperature vacuum furnace hot zone in accordance with claim 33 wherein said connector plate means is formed with an angle of between approximately 100° to 165° between the ends thereof.

36. The high temperature vacuum furnace hot zone in accordance with claim 33 wherein said connector plate means is formed with an angle of approximately 144° between the ends thereof.

37. The high temperature vacuum furnace hot zone in accordance with claim 30 wherein the ones of said insulation board means that are not otherwise secured to said outer surface of one of said individual boards by said heating element standoff means and said gas cooling nozzle means, are secured to said hot zone by retainer pin means, one end thereof being operatively secured to said outer surface of said one of said individual boards and the other end thereof being operatively secured to said heating element means.

38. The high temperature vacuum furnace hot zone in accordance with claim 30 wherein said gas cooling nozzle means is tapered at one end thereof and has a reduced mass for providing greater thermal energy efficiency and reduced conductive heat loss from said hot zone.

39. The high temperature vacuum furnace hot zone in accordance with claim 23 wherein the furnace includes a water-cooled outer wall and a void between said furnace outer wall and said outer surfaces of said individual boards forming a plenum for the transmission of high velocity cooling gas to flow through said gas cooling nozzle means to the workpiece in said hot zone.

40. The high temperature vacuum furnace hot zone in accordance with claim 22 wherein said insulation board means assembly is in the shape of a polygon.

41. The high temperature vacuum furnace hot zone in accordance with claim 22 wherein said heating element means ring is in the shape of a polygon.

42. The high temperature vacuum furnace hot zone in accordance with claim 22 wherein said insulation board means is coated with a polymeric graphite coating means for providing faster pump down rates, deeper vacuum levels, and reduced cycle times with less energy consumption during a heat treating cycle.

* * * * *